US008662913B2

(12) United States Patent
Tai et al.

(10) Patent No.: US 8,662,913 B2
(45) Date of Patent: Mar. 4, 2014

(54) ELECTRICAL CONNECTOR

(75) Inventors: Hung-Chi Tai, Jhonghe (TW); Zhi-Qiang Rong, Taicang (TW); Li-Li Liang, Taicang (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 0 days.

(21) Appl. No.: 13/476,548

(22) Filed: May 21, 2012

(65) Prior Publication Data

US 2013/0260593 A1 Oct. 3, 2013

(30) Foreign Application Priority Data

Mar. 29, 2012 (CN) ..... 2012 1 0087516

(51) Int. Cl.
*H01R 4/50* (2006.01)

(52) U.S. Cl.
USPC ..... 439/345

(58) Field of Classification Search
USPC ..... 439/345, 607.05, 329, 660, 358, 439/353–357, 540.1
See application file for complete search history.

(56) References Cited

U.S. PATENT DOCUMENTS

| | | | | |
|---|---|---|---|---|
| 4,718,857 | A * | 1/1988 | Noschese | 439/292 |
| 8,062,049 | B2 * | 11/2011 | Tobey | 439/345 |
| 8,215,990 | B2 * | 7/2012 | Ho | 439/607.05 |
| 2010/0279534 | A1 * | 11/2010 | Byrnes et al. | 439/329 |
| 2011/0021058 | A1 * | 1/2011 | Todo et al. | 439/345 |
| 2011/0177699 | A1 * | 7/2011 | Crofoot et al. | 439/61 |

* cited by examiner

*Primary Examiner* — Jean F Duverne
(74) *Attorney, Agent, or Firm* — Sughrue Mion, PLLC

(57) ABSTRACT

An electrical connector (100) for engaging with a complementary connector, includes an insulating housing (10) and pairs of power contacts (20) assembled in the insulating housing. The insulating housing defines a number of receiving passageways (11) extending therethrough along a front-to-back direction. The pairs of power contacts are received in corresponding receiving passageways, respectively. The insulating housing defines at least one hole (13) between two adjacent receiving passageways. The at least one hole communicates with the two adjacent receiving passageways for heat dissipation purposes.

10 Claims, 6 Drawing Sheets

ELECTRICAL CONNECTOR

BACKGROUND OF THE INVENTION

1. Field of the Invention

The present invention relates to an electrical connector, and more particularly to an electrical connector for engaging with a complementary connector.

2. Description of Related Art

Generally, a conventional power connector includes an insulating housing and a plurality of power contacts received in the insulating housing. With the development of the industry, large current is more desired to be used in the electrical devices, which in turn, the design issue of how to dissipate such a large amount of heat needs to confront. In the meanwhile, changing of the configuration of the power contact of the connector is also another design issue needed to be cared.

Hence, an electrical connector with improved housing structure to settle above-described design issues is desired.

BRIEF SUMMARY OF THE INVENTION

The present invention provides an electrical connector for engaging with a complementary connector. The electrical connector comprises an insulating housing and pairs of power contacts assembled in the insulating housing. The insulating housing defines a plurality of receiving passageways extending therethrough along a front-to-back direction. The pairs of power contacts are received in corresponding receiving passageways, respectively. The insulating housing defines at least one hole between two adjacent receiving passageways. The at least one hole communicates with the two adjacent receiving passageways for heat dissipation purposes.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
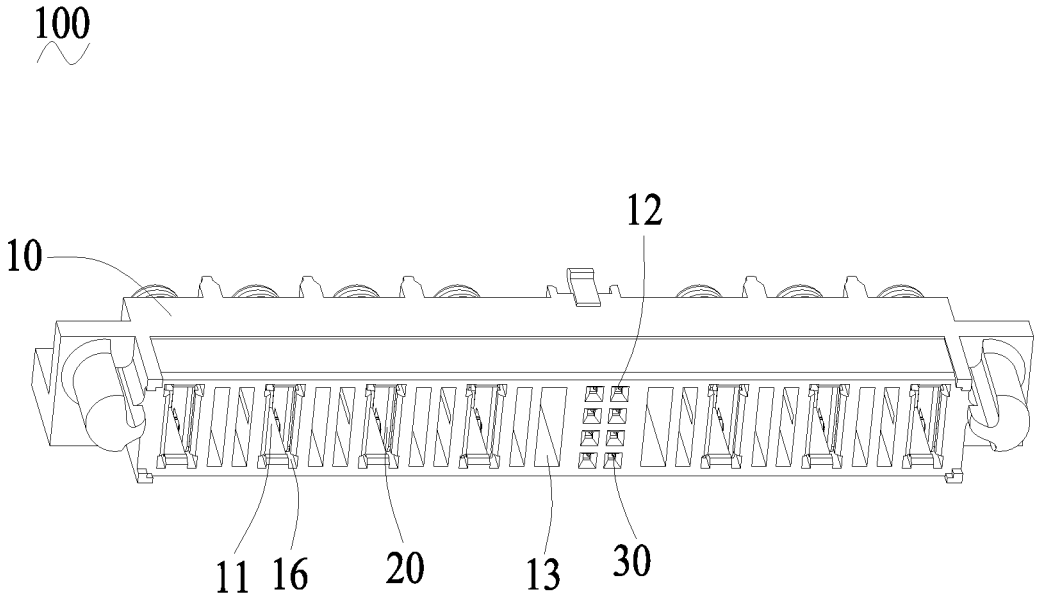
FIG. 1 is a perspective view of an electrical connector in accordance with the present invention.

Reference will now be made to the drawing figures to describe the embodiments of the present invention in detail. In the following description, the same drawing reference numerals are used for the same elements in different drawings.

Figure 2:
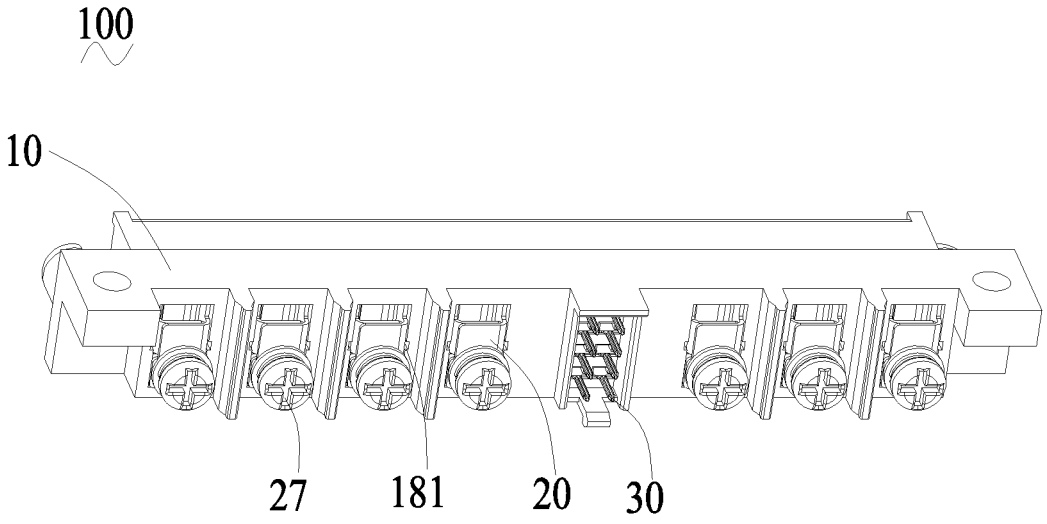
FIG. 2 is a perspective view similar to FIG. 1 while taken from another aspect.
Figure 3:
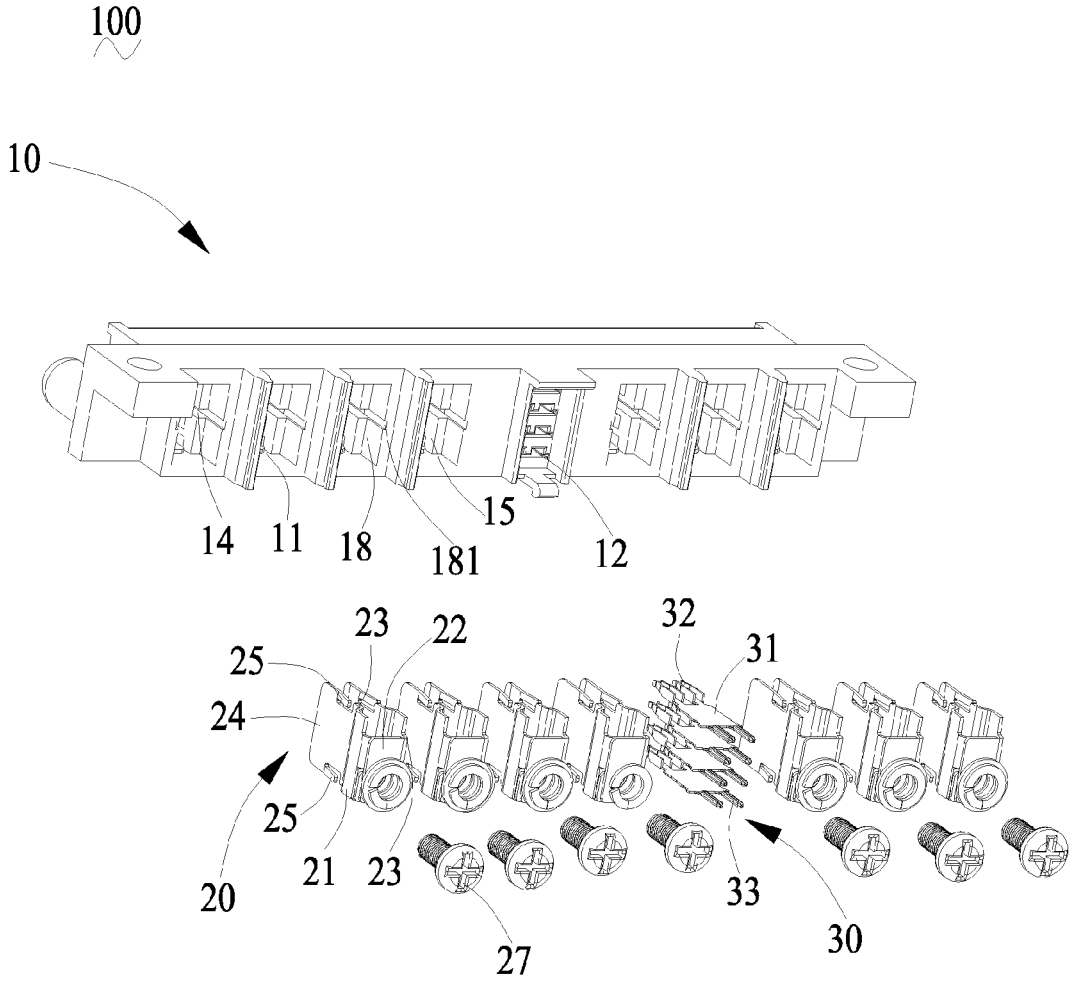
FIG. 3 is an exploded perspective view of the electrical connector.

Referring to FIGS. 1-3, an electrical connector 100 in accordance with the present invention, which is configured to engaging with a complementary connector (not shown), comprises an insulating housing 10, a plurality of power contacts 20 assembled in the insulating housing 10, and a plurality of signal contacts 30 assembled in the insulating housing 10 for transmitting signals. In the preferred embodiment, the plurality of power contacts are arranged into pairs.

Figure 4:
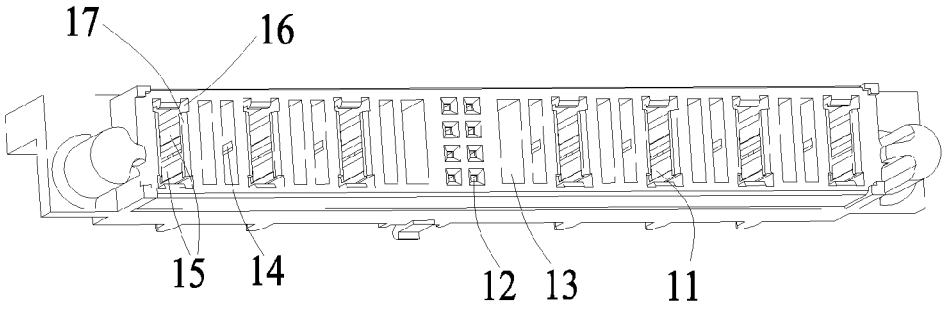
FIG. 4 is a perspective view of an insulating housing of the electrical connector.
Figure 5:
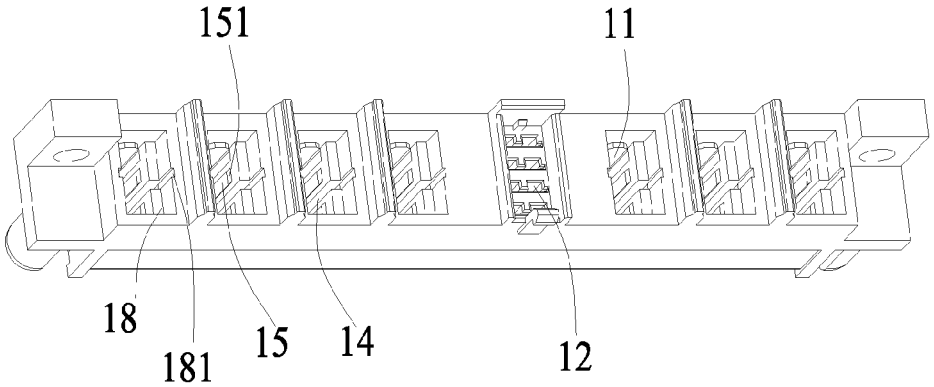
FIG. 5 is a perspective view similar to FIG. 4 while taken from another aspect.

Turning to FIG. 4 and FIG. 5, the insulating housing 10 defines a plurality of receiving passageways 11, 12 for correspondingly receiving the pairs of power contacts 20 and the signal contacts. In the preferred embodiment, the structures of the power contact 20 and the signal contact 30 are different from each other. Correspondingly, the shapes of first receiving passageway 11 for receiving the power contacts 20 and the shapes of second receiving passageway 12 for receiving the signal contacts 30 are also different. However, in some cases, the structures of the power contact and the signal contact can be same.

The insulating housing 10 provides a plurality of holes 13 parallel to the first receiving passageways 11. In the preferred embodiment, there are two holes 13 defined between each two adjacent first receiving passageways 11. While, the number of the holes 13 can be changed according to the applied environment. Each of first receiving passageway 11 defines a heat dissipation slot 14 through an inner wall (not labeled) thereof. The heat dissipation slot 14 communicates the hole 13 of the first receiving passageway 11 with an adjacent first receiving passageway 11. The first receiving passageway 11 provides two guiding blocks 15 respectively at upper and lower sides of the inner wall thereof. The guiding block 15 forms a slantingly extended, guiding face 151. The guiding face 151 guides the power contact 20 inserted therealong and the power contact 20 abuts against on the guiding face 151. A space (not labeled) is defined between the inner wall of the first receiving passageway 11 and corresponding power contact 20 received therein. A plurality of recesses 16 are also recessed from the inner walls of the first receiving passageways 11. The heat generated from the power contacts 20 can be dissipated through the space, the heat dissipation slots 14 and the recesses 16. Correspondingly, a reliable current transmission is achieved.

The first receiving passageway 11 forms a protrusion 17 in the front thereof and a receiving opening 18 in the rear thereof. There is a cutout 181 defined in the receiving opening 18, which communicates with corresponding heat dissipation slots 14.

Figure 6:
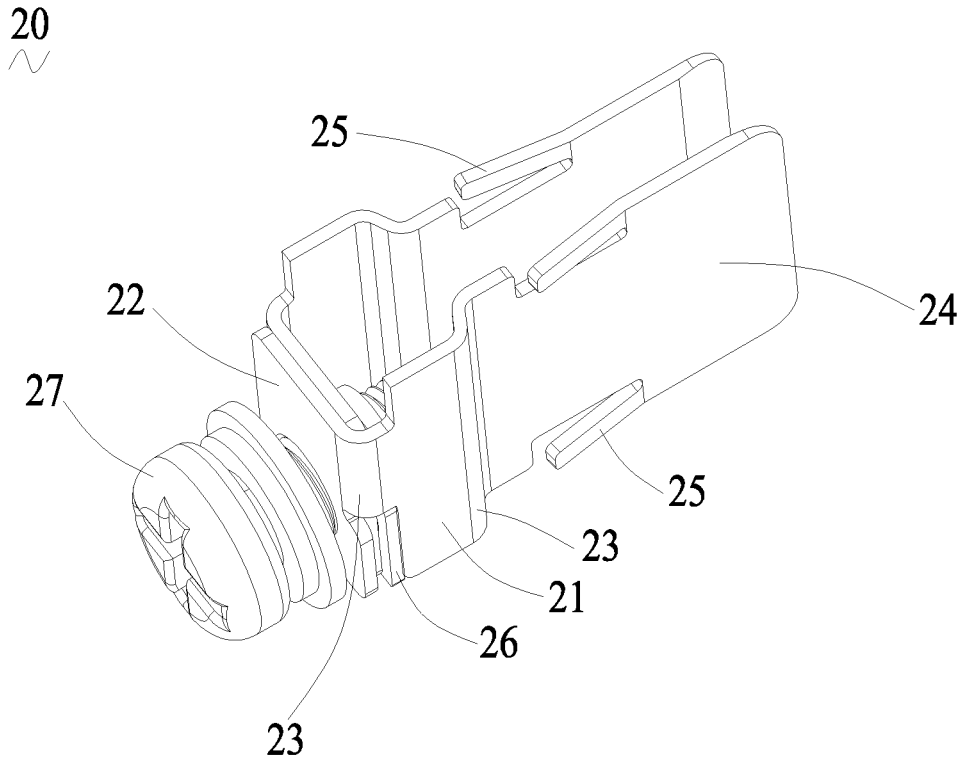
FIG. 6 is a perspective view of a pair of power contacts of the electrical connector.
Figure 7:
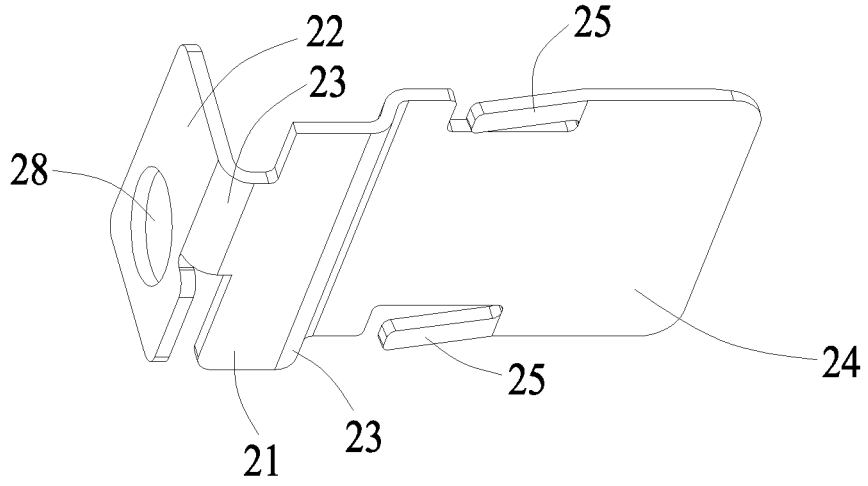
FIG. 7 is a perspective view of one of the pair of power contacts of the electrical connector.

Referring to FIG. 6 and FIG. 7, each power contact 20 has a base portion 21, a retaining portion 22 extending from one side of the base portion 21, a contacting portion 24 extending from another side of the base portion 21, and a bent portion 23 connected between the contacting portion 24 and the base portion 21. The power contacts 20 in the same pair are arranged in a mirror symmetry relation. The bent portion 23 is also formed between the base portion 21 and the retaining portion 22. The retaining portion 22 extends along a substantial perpendicular direction to the base portion 21. A retaining hole 28 is defined through the retaining portion 22 of the power contact 20. The contacting portion 24 of the power contact 20 forms a pair of tabs 25 on opposite edges thereof. The tab 25 extends outwards and rearwards toward the retaining portion 22. The protrusion 17 of the first receiving passageway 11 prevents a forwarding movement of the contacting portion 24 of the power contact 20. The engagement between the recess 16 of the first receiving passageway 11 and corresponding tab 25 of the power contact 20 prevents the tab 25 from displacing along a front-to-back direction to thereby avoiding undesired falling off of the power contact 20. Therefore, the movements either along a heightwise direction, a widthwise direction or along a lengthwise direction of the electrical connector, can be limited by the engagements between the contacting portion 24 with the protrusion 17 and between the tab 25 with the recess 16.

The electrical connector 100 also comprises a gasket 26 and a screw 27, which cooperate with the retaining portion 22 of the pair of power contacts 20 to thereby sure the pair of power contacts 20 together. More detailedly, the screw 27 is inserted through the retaining hole 28 of the retaining portion 22, abuts against on the gasket 26, and finally screws the two power contacts 20.

Figure 8:
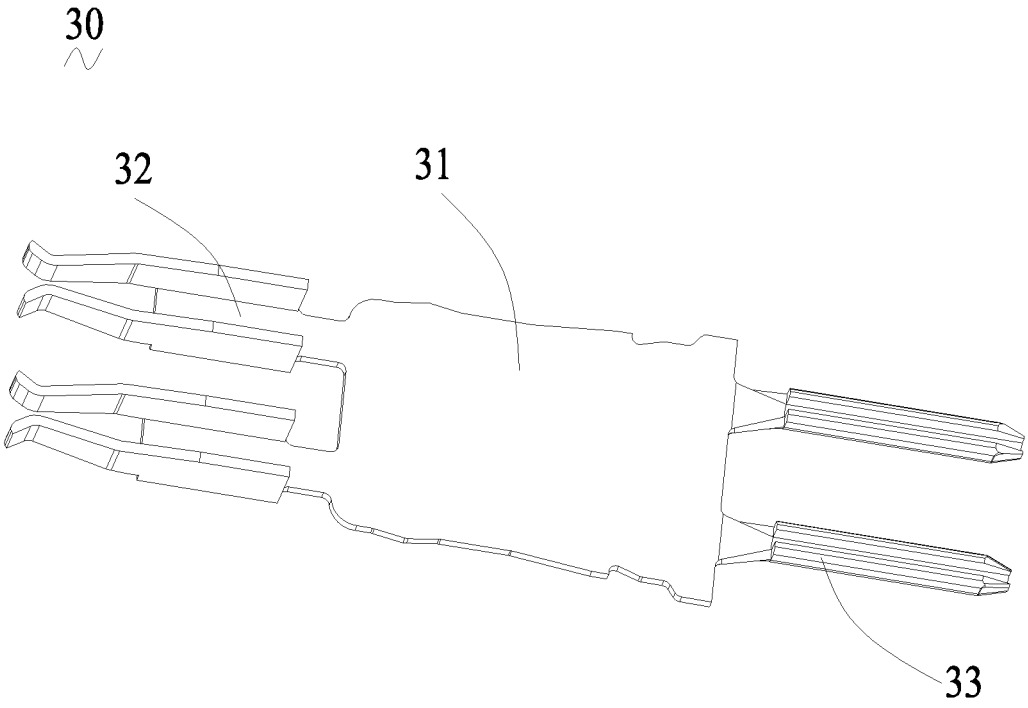
FIG. 8 is a perspective view of one signal contact of the electrical connector.

Together referring to FIG. 8 and FIG. 3, the plurality of signal contacts 30 each comprises an insertion portion 31 received in corresponding second receiving passageway 12, a contacting end 32 extending outwards from one side of the insertion portion 31, and a tail end 33 extending from another side of the insertion portion 31. In the preferred embodiment, the insertion portion 31 is configured as a planar plate and two contacting ends 32 are extending from the insertion portion 31. There are also two tail ends 33 formed on the signal contact 30. The central line of the two contacting ends 32 and the central line of the two tail ends 33 are overlapped with each other.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for engaging with a complementary connector, comprising:

an insulating housing defining a plurality of receiving passageways extending therethrough along a front-to-back direction; and pairs of power contacts received in corresponding receiving passageways, respectively;

wherein said insulating housing defines at least one hole between two adjacent receiving passageways, and wherein said at least one hole communicating with said two adjacent receiving passageways;

wherein each power contact comprises a base portion, a retaining portion extending from one side of said portion, a contacting portion extending from another side of said base portion, and a bent portion between said base portion and said contacting portion, and wherein each pair of power contacts are arranged in a mirror symmetrical relation.

2. The electrical connector as claimed in claim 1, wherein said insulating housing defines a heat dissipation slot in an inner wall of said receiving passageway, and wherein said heat dissipation slot communicates said receiving passageway with said at least one hole.

3. The electrical connector as claimed in claim 2, wherein said insulating housing provides a guiding block on said inner wall of said receiving passageway, and wherein said guiding block defines a guiding face for guiding said power contact inserted therein.

4. The electrical connector as claimed in claim 3, wherein said power contact abuts against said guiding face, and wherein a space is defined between said inner wall of said receiving passageway and said power contact.

5. The electrical connector as claimed in claim 1, wherein said insulating housing provides a protrusion in the front of said receiving passageway thereby limiting a forward movement of said contacting portion of said power contact received therein.

6. The electrical connector as claimed in claim 1, wherein each contacting portion of each power contact has at least one tab formed at one lateral edge thereof, and wherein said at least one tab extends outwards and rearwards toward said retaining portion.

7. The electrical connector as claimed in claim 6, wherein said receiving passageway defines at least one recess recessed from said inner wall thereof, and wherein said at least one tab of said power contact engaged within said at least one recess to thereby limit a rearwards movement of said power contact.

8. The electrical connector as claimed in claim 1, further comprising gaskets and screws, wherein said gasket and said screw engage with corresponding retaining portion of said power contact to thereby secure said power contact within said receiving passageway.

9. The electrical connector as claimed in claim 1, further comprising a plurality of signal contacts assembled in said insulating housing.

10. The electrical connector as claimed in claim 9, wherein each signal contact comprises an insertion portion, a contacting end extending from one side of said insertion portion and a tail end extending outwards from another side of said insertion portion.

* * * * *